US011162239B2

(12) United States Patent
Kondo et al.

(10) Patent No.: US 11,162,239 B2
(45) Date of Patent: Nov. 2, 2021

(54) HYDRAULIC DRIVE SYSTEM

(71) Applicant: KAWASAKI JUKOGYO KABUSHIKI KAISHA, Kobe (JP)

(72) Inventors: Akihiro Kondo, Kobe (JP); Hideyasu Muraoka, Akashi (JP); Jun Umekawa, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/766,439

(22) PCT Filed: Nov. 20, 2018

(86) PCT No.: PCT/JP2018/042866
§ 371 (c)(1),
(2) Date: May 22, 2020

(87) PCT Pub. No.: WO2019/103001
PCT Pub. Date: May 31, 2019

(65) Prior Publication Data

US 2021/0156109 A1 May 27, 2021

(30) Foreign Application Priority Data

Nov. 22, 2017 (JP) ..... JP2017-224620

(51) Int. Cl.
*E02F 9/22* (2006.01)
*E02F 3/42* (2006.01)
*F15B 11/16* (2006.01)

(52) U.S. Cl.
CPC ..... *E02F 3/422* (2013.01); *E02F 9/2203* (2013.01); *E02F 9/2285* (2013.01); *E02F 9/2296* (2013.01); *F15B 11/162* (2013.01)

(58) Field of Classification Search
CPC ..... E02F 9/2203; E02F 9/2285; E02F 9/2296; F15B 11/162; F15B 11/166; F15B 11/167
See application file for complete search history.

(56) References Cited

U.S. PATENT DOCUMENTS 5,291,676 A * 3/1994 Beater ..... F15B 11/166 60/422
5,784,883 A * 7/1998 Ohkura ..... B60W 10/06 60/327

(Continued)

FOREIGN PATENT DOCUMENTS

CN 104364535 A 2/2015
DE 102012110070 A1 * 4/2014 ..... E02F 9/2225

(Continued)

*Primary Examiner* — F Daniel Lopez
*Assistant Examiner* — Matthew Wiblin
(74) *Attorney, Agent, or Firm* — Oliff PLC

(57) ABSTRACT

A hydraulic drive system includes a hydraulic pump, a boom-dedicated control valve, a turning-dedicated control valve, a boom-dedicated operation unit, a turning-dedicated operation unit, and a driving control unit. If an operating amount of the turning-dedicated operating portion where a concurrent operation is performed and a single operation is performed are the same, the driving control unit adjusts a turning driving command, that an opening area between the hydraulic pump and a turning motor where the concurrent operation is performed is less than the opening area between the hydraulic pump and the turning motor where the single operation is performed, the concurrent operation wherein the turning operation command is outputted from the turning-dedicated operation unit and a boom operation command is outputted from the boom-dedicated operation unit, the single operation wherein the turning operation command is outputted, but the boom operation command is not outputted from the boom-dedicated operation unit.

6 Claims, 4 Drawing Sheets

(56) References Cited

U.S. PATENT DOCUMENTS

| | | | | |
|---|---|---|---|---|
| 6,557,277 | B1 * | 5/2003 | Hibi | E02F 3/4135 37/187 |
| 2012/0093624 | A1 * | 4/2012 | Ohhigashi | E02F 9/2203 414/722 |
| 2015/0219123 | A1 * | 8/2015 | Nishikawa | F15B 11/165 60/393 |
| 2015/0292184 | A1 * | 10/2015 | Kondo | E02F 9/2296 60/463 |
| 2017/0350094 | A1 * | 12/2017 | Yudate | B66C 23/86 |

FOREIGN PATENT DOCUMENTS

| | | | |
|---|---|---|---|
| JP | H08-302751 | A | 11/1996 |
| JP | 2002-295405 | A | 10/2002 |

* cited by examiner

HYDRAULIC DRIVE SYSTEM

TECHNICAL FIELD

The present invention relates to a hydraulic drive system that supplies pressurized oil to a boom-dedicated cylinder and a turning motor, thereby driving the boom-dedicated cylinder and the turning motor.

BACKGROUND ART

A boom-dedicated cylinder and a turning motor that are installed in a hydraulic excavator can be driven by supplying pressurized oil to the boom-dedicated cylinder and the turning motor. For example, a boom raising prioritizing hydraulic circuit of Patent Literature 1 is known as a hydraulic circuit that supplies the pressurized oil to the boom-dedicated cylinder and the turning motor. The boom raising prioritizing hydraulic circuit of Patent Literature 1 includes a first boom-dedicated directional control valve and a turning-dedicated directional control valve. The first boom-dedicated directional control valve and the turning-dedicated directional control valve are connected to a first hydraulic pump in parallel with each other. When a turning operation is performed, the turning-dedicated directional control valve flows the pressurized oil to the turning motor, thereby moving the turning motor. When a boom raising operation is performed, the first boom-dedicated directional control valve flows the pressurized oil to the boom-dedicated cylinder, thereby moving the boom.

Further, in the boom raising prioritizing hydraulic circuit, a switching valve is interposed between the turning-dedicated directional control valve and the first hydraulic pump. When a boom raising operation is performed, the switching valve switches from an open position to a restricting position. That is, when a turning operation and a boom raising operation are performed concurrently, the switching valve switches to the restricting position, thereby restricting the flow rate of the pressurized oil flowing from the first hydraulic pump to the turning-dedicated directional control valve, i.e., restricting the flow rate of the pressurized oil flowing to the turning motor. Accordingly, even when such a concurrent operation is performed, the flow rate of the pressurized oil flowing to the first boom-dedicated directional control valve, i.e., the flow rate of the pressurized oil flowing to the boom-dedicated cylinder, can be secured, and thereby a decrease in the raising speed of the boom-dedicated cylinder compared to when a single operation is performed is suppressed, i.e., degradation in operability is suppressed.

CITATION LIST

Patent Literature

PTL 1: Japanese Laid-Open Patent Application Publication No. H08-302751

SUMMARY OF INVENTION

Technical Problem

In the boom raising prioritizing hydraulic circuit of Patent Literature 1, since the switching valve is provided between the turning-dedicated directional control valve and the first hydraulic pump, when flowing the hydraulic oil to the turning-dedicated directional control valve, it is always necessary to flow the hydraulic oil through the switching valve regardless of whether or not a concurrent operation is performed. Since pressure loss occurs at the switching valve, energy is wastefully consumed when a single operation is performed.

In view of the above, an object of the present invention is to provide a hydraulic drive system that makes it possible to suppress the occurrence of wasteful pressure loss.

Solution to Problem

A hydraulic drive system of the present invention includes: a hydraulic pump that delivers hydraulic oil to supply the hydraulic oil to a boom-dedicated cylinder and a turning motor; a boom-dedicated control valve interposed between the hydraulic pump and the boom-dedicated cylinder, the boom-dedicated control valve adjusting an opening area between the hydraulic pump and the boom-dedicated cylinder in accordance with a boom driving command inputted to the boom-dedicated control valve; a turning-dedicated control valve interposed between the hydraulic pump and the turning motor and connected to the hydraulic pump such that the turning-dedicated control valve is parallel to the boom-dedicated control valve, the turning-dedicated control valve adjusting an opening area between the hydraulic pump and the turning motor in accordance with a turning driving command inputted to the turning-dedicated control valve; a boom-dedicated operation unit including a boom-dedicated operating portion that is configured to be operable to input the boom driving command to the boom-dedicated control valve, the boom-dedicated operation unit outputting a boom operation command corresponding to an operating amount of the boom-dedicated operating portion; a turning-dedicated operation unit including a turning-dedicated operating portion that is configured to be operable to input the turning driving command to the turning-dedicated control valve, the turning-dedicated operation unit outputting a turning operation command corresponding to an operating amount of the turning-dedicated operating portion; and a driving control unit that adjusts the turning driving command based on the boom operation command outputted from the boom-dedicated operation unit and the turning operation command outputted from the turning-dedicated operation unit. If the operating amount of the turning-dedicated operating portion in a case where a concurrent operation is performed and the operating amount of the turning-dedicated operating portion in a case where a single operation is performed are the same as each other, the driving control unit adjusts the turning driving command, such that the opening area between the hydraulic pump and the turning motor in the case where the concurrent operation is performed is less than the opening area between the hydraulic pump and the turning motor in the case where the single operation is performed, the concurrent operation being an operation in which the turning operation command is outputted from the turning-dedicated operation unit and the boom operation command is outputted from the boom-dedicated operation unit, the single operation being an operation in which the turning operation command is outputted from the turning-dedicated operation unit, but the boom operation command is not outputted from the boom-dedicated operation unit.

According to the present invention, when the concurrent operation is performed, the opening area between the hydraulic pump and the turning motor is made less than when the single operation is performed, and thereby the hydraulic oil flowing to the turning motor is restricted, which makes it possible to flow the hydraulic oil to the boom-dedicated cylinder in a prioritized manner. On the other hand, when the single operation is performed, the opening area between the hydraulic pump and the turning motor can be made greater than when the concurrent operation is performed, which makes it possible to suppress the occurrence of wasteful pressure loss when the single operation is performed.

In the above-described invention, in the case where the concurrent operation is performed, the driving control unit may adjust the turning driving command, such that the opening area between the hydraulic pump and the turning motor is less than or equal to an upper limit value. The above hydraulic drive system may further include a priority degree adjuster that is capable of changing the upper limit value.

According to the above configuration, to what extent the opening area is made less when the concurrent operation is performed can be adjusted. That is, the degree of priority of flowing the hydraulic oil to the boom-dedicated cylinder can be adjusted. Accordingly, even in the same concurrent operation, by changing the degree of priority, the driving speed of the turning motor and the boom-dedicated cylinder can be changed, and thus, a degree of freedom can be achieved in the driving control of the turning motor and the boom-dedicated cylinder when the concurrent operation is performed.

In the above-described invention, in the case where the concurrent operation is performed, if a state in which the turning-dedicated operating portion is operated by a predetermined operating amount has continued for a predetermined time, the driving control unit may adjust the turning driving command to bring the opening area between the hydraulic pump and the turning motor back to the same opening area as in the case where the single operation is performed.

According to the above configuration, when the concurrent operation is performed continuously, the hydraulic oil can be flowed to the turning motor in order to move the turning motor in a prioritized manner. This makes it possible to lower the risk that the movement of the turning motor is kept restricted indefinitely.

In the above-described invention, in the case where the concurrent operation is performed, when the turning-dedicated operating portion is operated and the opening area between the hydraulic pump and the turning motor is adjusted, the driving control unit may restrict an increase/decrease rate of the turning driving command to be less than or equal to a predetermined increase/decrease rate.

According to the above configuration, when the concurrent operation is performed, the opening area between the hydraulic pump and the turning motor can be prevented from rapidly increasing or rapidly decreasing, and thereby the amount of hydraulic oil flowing into the turning motor can be prevented from rapidly increasing or rapidly decreasing. Therefore, even when the turning-dedicated operating portion is operated rapidly, the occurrence of a shock on a structure driven by the turning motor, i.e., the occurrence of a shock on a turning unit, can be suppressed.

In the above-described invention, when a percentage of the operating amount of the turning-dedicated operating portion to a maximum operating amount of the turning-dedicated operating portion is higher than or equal to a first predetermined percentage, and a percentage of the operating amount of the boom-dedicated operating portion to a maximum operating amount of the boom-dedicated operating portion is higher than or equal to a second predetermined percentage, the driving control unit may adjust the turning driving command.

According to the above configuration, when the percentages of the operating amounts of the operating portions to the maximum operating amounts are less than the predetermined percentages, the priority control can be prevented from being performed. That is, in the above-described case, when the operating portions are operated, the operations performed on the operating portions and movements of the boom-dedicated cylinder and the turning motor can be made correspond to each other, and even when the concurrent operation is performed, the boom-dedicated cylinder and the turning motor can be moved while finely adjusting their movements.

In the above-described invention, the turning-dedicated operation unit may output, as the turning driving command, a pilot pressure whose magnitude corresponds to the operating amount of the turning-dedicated operating portion. The turning-dedicated control valve may control the opening area between the hydraulic pump and the turning motor in accordance with the pilot pressure. The driving control unit may include a solenoid proportional valve and a controller. The solenoid proportional valve may adjust the pilot pressure based on a turning control command inputted to the solenoid proportional valve. In the case where the concurrent operation is performed, the controller may output the turning control command to the solenoid proportional valve to adjust the pilot pressure, such that the opening area between the hydraulic pump and the turning motor is decreased.

According to the above configuration, the above-described functions can be realized in the hydraulic drive system in which the turning-dedicated control valve is driven by an operation valve.

In the above-described invention, the driving control unit may include a solenoid proportional valve and a controller. The solenoid proportional valve may output, as the turning driving command to the turning-dedicated control valve, a pilot pressure whose magnitude corresponds to a turning control command inputted to the solenoid proportional valve. The controller may: in the case where the single operation is performed, output the turning control command to the solenoid proportional valve to cause the solenoid proportional valve to output the pilot pressure corresponding to the turning operation command outputted from the turning-dedicated operation unit; and in the case where the concurrent operation is performed, output the turning control command to the solenoid proportional valve to adjust the pilot pressure, such that the opening area between the hydraulic pump and the turning motor relative to the operating amount of the turning-dedicated operating portion is less than in the case where the single operation is performed.

According to the above configuration, the above-described functions can be realized in the hydraulic drive system in which the turning-dedicated control valve is driven by controlling the pilot pressure by the solenoid proportional valve.

Advantageous Effects of Invention

The present invention makes it possible to suppress the occurrence of wasteful pressure loss.

DESCRIPTION OF EMBODIMENTS

Hereinafter, hydraulic drive systems 1 and 1A of Embodiments 1 and 2 according to the present invention are described with reference to the drawings. It should be noted that directions mentioned in the description below are used for the sake of convenience of the description, but do not suggest that the orientation and the like of the components of the present invention are limited to such directions. The hydraulic drive systems 1 and 1A described below are merely embodiments of the present invention. Therefore, the present invention is not limited to these embodiments, and additions, deletions, and modifications can be made to the embodiments without departing from the scope of the present invention.

[Construction Machine]

A construction machine, such as a hydraulic excavator or a hydraulic crane, is equipped with various attachments such as a bucket and a hoist. The construction machine lifts/lowers these attachments by a boom. The construction machine includes a turning unit turnably provided on, for example, a running unit. The boom is provided on the turning unit in such a manner that the boom is swingable in the vertical direction. That is, by rotating the turning unit, the orientation of the boom, i.e., the positions of the attachments, can be changed. The construction machine performs work while moving the boom and the turning unit. Although the construction machine includes an arm and other components in addition to the boom, the description of the arm and other components is omitted in the present embodiment.

Figure 1:
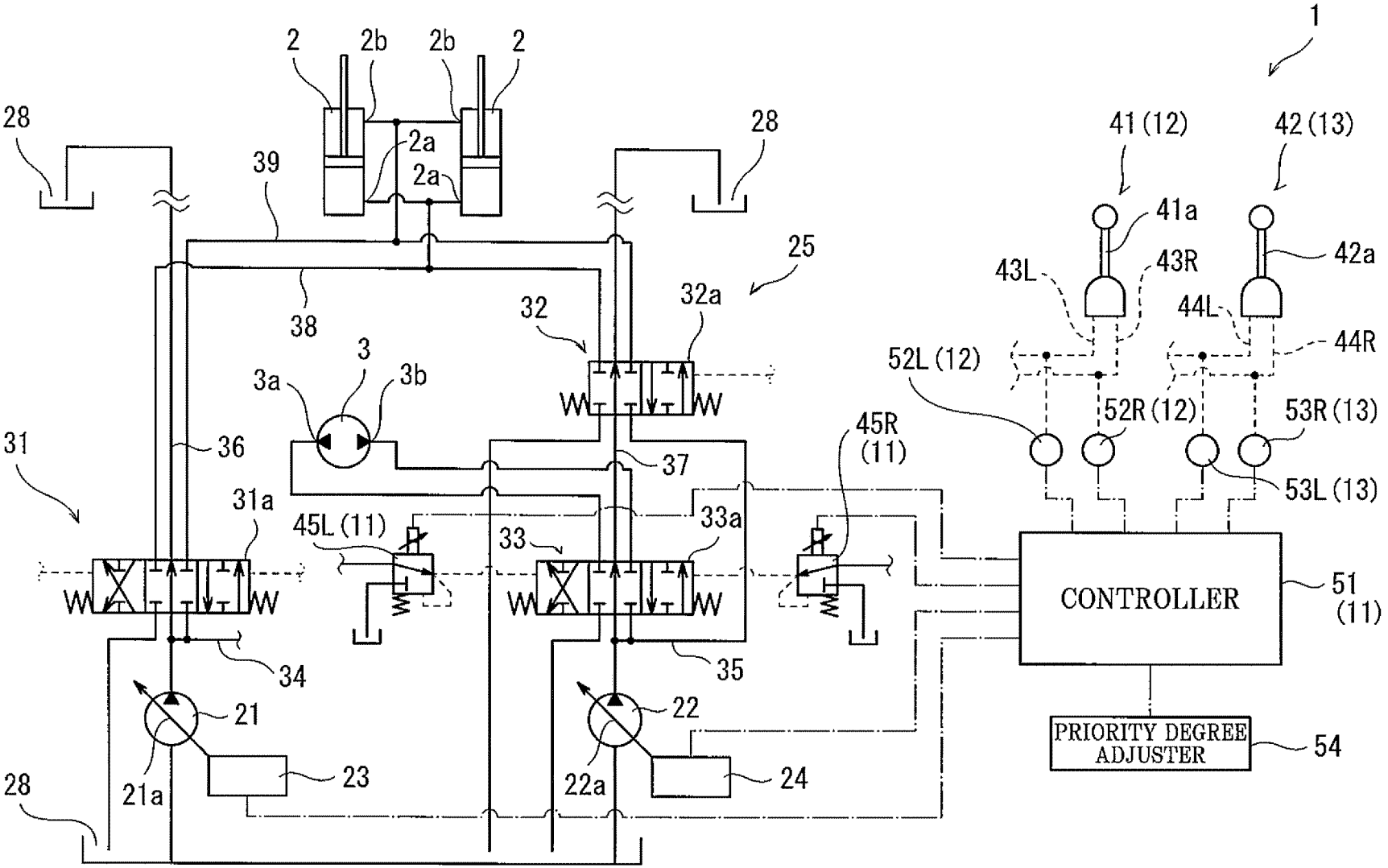
FIG. 1 is a circuit diagram showing a hydraulic circuit of a hydraulic drive system according to Embodiment 1 of the present invention.
Figure 2:
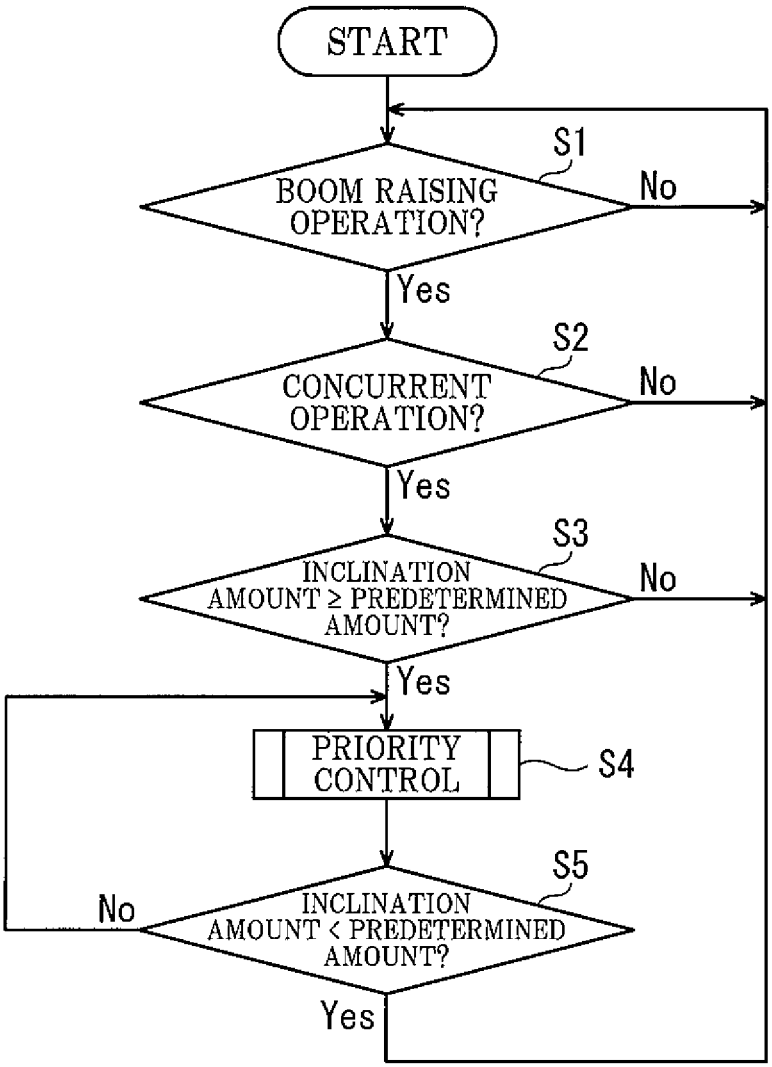
FIG. 2 is a flowchart showing the steps of driving each actuator in the hydraulic drive system of FIG. 1.

A hydraulic excavator that is one example of the construction machine includes a pair of boom-dedicated cylinders 2 and a turning motor 3 as shown in FIG. 1 in order to move the boom and the turning unit. The pair of boom-dedicated cylinders 2 extends or retracts by being supplied with and discharging hydraulic oil, thereby swinging the boom in the vertical direction. The turning motor 3 rotates an unshown output shaft by being supplied with and discharging pressurized oil, thereby rotating the turning unit. In the construction machine, the hydraulic oil is supplied to various actuators, including the boom-dedicated cylinders 2 and the turning motor 3 thus configured, and thereby these various actuators are driven. In order to supply the hydraulic oil to the various actuators, the construction machine includes, for example, the hydraulic drive system 1 or 1A of Embodiment 1 or 2.

Embodiment 1

The hydraulic drive system 1 is connected to the boom-dedicated cylinders 2 and the turning motor 3. The hydraulic drive system 1 supplies the hydraulic oil to each of the boom-dedicated cylinders 2 and the turning motor 3, thereby moving each of the boom-dedicated cylinders 2 and the turning motor 3. It should be noted that the hydraulic drive system 1, which is connected to the boom-dedicated cylinders 2 and the turning motor 3, is also connected to actuators such as an arm cylinder for moving the arm, a bucket cylinder for moving the bucket, and a running-dedicated motor for moving the running unit. The hydraulic drive system 1 supplies the hydraulic oil to each of the actuators, thereby moving each of the actuators. In the embodiments described below, the illustration and detailed description of the actuators other than the boom-dedicated cylinders 2 and the turning motor 3 particularly related to the present invention are omitted.

The hydraulic drive system 1 having the above-described functions includes two hydraulic pumps 21 and 22, tilting angle adjusting mechanisms 23 and 24, and a hydraulic pressure supply device 25. An unshown rotating shaft of each of the two hydraulic pumps 21 and 22 is connected to a driving source such as an engine or an electric motor, and each of the two hydraulic pumps 21 and 22 delivers the pressurized oil as a result of its rotating shaft being rotated by the driving source. The two hydraulic pumps 21 and 22 are variable displacement swash plate pumps, and include swash plates 21*a* and 22*a*, respectively. That is, the delivery capacity of each of the two hydraulic pumps 21 and 22 can be changed by changing the tilting angle of a corresponding one of the swash plates 21*a* and 22*a*. In order to change the tilting angles of the swash plates 21*a* and 22*a*, the swash plates 21*a* and 22*a* are provided with the tilting angle adjusting mechanisms 23 and 24, respectively.

The first tilting angle adjusting mechanism 23 is provided on the swash plate 21*a* of the first hydraulic pump 21, which is one hydraulic pump 21. The first tilting angle adjusting mechanism 23 adjusts the tilting angle of the swash plate 21*a* to an angle corresponding to a first tilting signal (first tilting angle command) inputted to the first tilting angle adjusting mechanism 23. The first tilting angle adjusting mechanism 23 includes, for example, a tilting angle adjusting valve and a servo mechanism (that are not shown). The tilting angle adjusting valve is a solenoid proportional valve, for example. The tilting angle adjusting valve decreases the pressure of pressurized oil delivered from an unshown pilot pump to a command pressure corresponding to the inputted first tilting signal (first tilting angle command), and outputs the pressurized oil having the command pressure to the servo mechanism. The servo mechanism includes a servo piston to which the swash plate 21*a* is coupled. The servo mechanism shifts the servo piston to a position corresponding to the command pressure outputted from the tilting angle adjusting valve. As a result, the tilting angle of the swash plate 21*a* is adjusted to an angle corresponding to the first tilting signal, and the hydraulic oil at a delivery flow rate corresponding to the first tilting signal is delivered from the first hydraulic pump 21.

The second tilting angle adjusting mechanism 24 is provided on the swash plate 22*a* of the second hydraulic pump 22, which is the other hydraulic pump 22. The second tilting angle adjusting mechanism 24 adjusts the tilting angle of the swash plate 22*a* to an angle corresponding to a second tilting signal (second tilting angle command) inputted to the second tilting angle adjusting mechanism 24. That is, similar to the first tilting angle adjusting mechanism 23, the second tilting angle adjusting mechanism 24 includes a tilting angle adjusting valve and a servo mechanism (that are not shown). By means of the tilting angle adjusting valve and the servo mechanism, the tilting angle of the swash plate 22*a* is adjusted to an angle corresponding to the second tilting signal, and the hydraulic oil at a delivery flow rate corresponding to the second tilting signal is delivered from the second hydraulic pump 22.

The two hydraulic pumps 21 and 22 having the above-described functions are connected to the actuators 2 and 3 via the hydraulic pressure supply device 25, and the hydraulic oil is supplied to the actuators 2 and 3 via the hydraulic pressure supply device 25. The hydraulic pressure supply device 25 switches the direction of the hydraulic oil supplied to each of the actuators 2 and 3, and also changes the flow rate of the hydraulic oil supplied to each of the actuators 2 and 3. By thus switching the direction of the hydraulic oil, the driving direction of each of the actuators 2 and 3 is switched, and also, by changing the flow rate of the hydraulic oil, the driving speed of each of the actuators 2 and 3 is changed. To be more specific, the hydraulic pressure supply device 25 includes a first boom-dedicated directional control valve 31, a second boom-dedicated directional control valve 32, and a turning-dedicated directional control valve 33.

The first boom-dedicated directional control valve 31 is a valve for controlling the movement of the pair of boom-dedicated cylinders 2. Specifically, the first boom-dedicated directional control valve 31 is connected to the first hydraulic pump 21 via a first main passage 34, and also connected to the pair of boom-dedicated cylinders 2 and a tank 28. The first boom-dedicated directional control valve 31 thus connected is a three-function directional control valve including a spool 31*a*. By moving the spool 31*a*, the first boom-dedicated directional control valve 31 switches the direction of the hydraulic oil flowing from the first hydraulic pump 21 to the pair of boom-dedicated cylinders 2. Specifically, when the spool 31*a* is in a neutral position, the first boom-dedicated directional control valve 31 blocks between the first hydraulic pump 21 and the pair of boom-dedicated cylinders 2. On the other hand, when the spool 31*a* shifts to a first offset position and when the spool 31*a* shifts to a second offset position, the first boom-dedicated directional control valve 31 brings the first hydraulic pump 21 and the pair of boom-dedicated cylinders 2 into connection with each other.

To be more specific, each of the pair of boom-dedicated cylinders 2 includes a head-side port 2*a* and a rod-side port 2*b*. The two head-side ports 2*a* are connected to the first boom-dedicated directional control valve 31 via a head-side passage 38, and the two rod-side ports 2*b* are connected to the first boom-dedicated directional control valve 31 via a rod-side passage 39. In the first boom-dedicated directional control valve 31, when the spool 31*a* shifts to the first offset position, the first hydraulic pump 21 connects to the rod-side passage 39, and the two rod-side ports 2*b* are brought into connection with the first hydraulic pump 21 via the rod-side passage 39. Meanwhile, the head-side passage 38 is brought into connection with the tank 28, and the two head-side ports 2*a* are brought into connection with the tank 28 via the head-side passage 38. As a result, the pair of boom-dedicated cylinders 2 retracts. When the spool 31*a* shifts to the second offset position, the first hydraulic pump 21 connects to the head-side passage 38, and the two head-side ports 2*a* are brought into connection with the first hydraulic pump 21 via the head-side passage 38. Meanwhile, the rod-side passage 39 is brought into connection with the tank 28, and the two rod-side ports 2*b* are brought into connection with the tank 28 via the rod-side passage 39. As a result, the pair of boom-dedicated cylinders 2 extends.

The first boom-dedicated directional control valve 31 having such functions is configured as an open-center directional control valve, and is interposed in a first center bypass passage 36. The first center bypass passage 36 is a passage branched off from the first main passage 34, and a downstream-side portion of the first center bypass passage 36 is connected to the tank 28. The first boom-dedicated directional control valve 31 closes the first center bypass passage 36 when the spool 31*a* is in the first offset position and when the spool 31*a* is in the second offset position, and opens the first center bypass passage 36 when the spool 31*a* is in the neutral position. With such a configuration, the hydraulic oil can be led to the pair of boom-dedicated cylinders 2 when the spool 31*a* is in the first offset position and when the spool 31*a* is in the second offset position.

Thus, in the hydraulic pressure supply device 25, by controlling, with the first boom-dedicated directional control valve 31, the flow direction and the flow rate of the hydraulic oil delivered from the first hydraulic pump 21, the pair of boom-dedicated cylinders 2 can be extended/retracted to swing the boom in the vertical direction. In the case of swinging the boom upward, (i.e., when a boom raising operation is performed), since the boom needs to be moved against the gravitational force, it is necessary to supply, to the pair of boom-dedicated cylinders 2, the hydraulic liquid at a higher flow rate than in the case of swinging the boom downward. For this reason, in the hydraulic pressure supply device 25, the hydraulic liquid can be supplied to the pair of boom-dedicated cylinders 2 also from the second hydraulic pump 22, and in order to realize such function, the hydraulic pressure supply device 25 includes the second boom-dedicated directional control valve 32.

The second boom-dedicated directional control valve 32 is a valve for controlling the movement (more specifically, retracting movement) of the pair of boom-dedicated cylinders 2 in cooperation with the first boom-dedicated directional control valve 31. The second boom-dedicated directional control valve 32 is connected to the second hydraulic pump 22 via a second main passage 35, and also connected to the pair of boom-dedicated cylinders 2 and the tank 28. The second boom-dedicated directional control valve 32 thus connected is a two-function directional control valve including a spool 32*a*. When the spool 32*a* is in a neutral position, the second boom-dedicated directional control valve 32 blocks between the second hydraulic pump 22 and the pair of boom-dedicated cylinders 2. On the other hand, when the spool 32*a* shifts to an offset position, the second boom-dedicated directional control valve 32 brings the second hydraulic pump 22 and the pair of boom-dedicated cylinders 2 into connection with each other.

To be more specific, the second boom-dedicated directional control valve 32 is connected to the head-side passage 38 and the rod-side passage 39. In the second boom-dedicated directional control valve 32, when the spool 32*a* shifts to the offset position, the second hydraulic pump 22 connects to the rod-side passage 39, and the two rod-side ports 2*b* are brought into connection with the second hydraulic pump 22 via the rod-side passage 39. Meanwhile, the head-side passage 38 connects to the tank 28, and the two head-side ports 2*a* are brought into connection with the tank 28 via the head-side passage 38. In this manner, the hydraulic oil from the first hydraulic pump 21 and the hydraulic oil from the second hydraulic pump 22 can be merged together and supplied to the two rod-side ports 2*b* in order to retract the pair of boom-dedicated cylinders 2.

The second boom-dedicated directional control valve 32 having such functions is also configured as an open-center directional control valve, and is interposed in a second center bypass passage 37. The second center bypass passage 37 is a passage branched off from the second main passage 35, and a downstream-side portion of the second main passage 35 is connected to the tank 28. The second boom-dedicated directional control valve 32 closes the second center bypass passage 37 when the spool 32*a* is in the offset position, and opens the second center bypass passage 37 when the spool 32*a* is in the neutral position. With such a configuration, the hydraulic oil can be led to the pair of boom-dedicated cylinders 2 when the spool 32*a* is in the offset position. In the second center bypass passage 37, upstream of the second boom-dedicated directional control valve 32, the turning-dedicated directional control valve 33 is interposed in series with the second boom-dedicated directional control valve 32. The turning-dedicated directional control valve 33 is also connected to the second main passage 35 in parallel with the second boom-dedicated directional control valve 32, and supplies the hydraulic liquid from the second hydraulic pump 22 to the turning motor 3.

The turning-dedicated directional control valve 33 is a valve for controlling the movement of the turning motor 3. The turning-dedicated directional control valve 33 is connected to the second hydraulic pump 22 via the second main passage 35, and also connected to the turning motor 3 and the tank 28. The turning-dedicated directional control valve 33 thus connected is a three-function directional control valve including a spool 33*a*. By moving the spool 33*a*, the turning-dedicated directional control valve 33 switches the direction of the hydraulic oil flowing from the second hydraulic pump 22 to the turning motor 3. Specifically, when the spool 33*a* is in a neutral position, the turning-dedicated directional control valve 33 blocks between the second hydraulic pump 22 and the turning motor 3. On the other hand, when the spool 33*a* shifts to a first offset position and when the spool 33*a* shifts to a second offset position, the turning-dedicated directional control valve 33 brings the second hydraulic pump 22 and the turning motor 3 into connection with each other.

To be more specific, the turning motor 3 includes two ports 3*a* and 3*b*. When the spool 33*a* shifts to the first offset position, the turning-dedicated directional control valve 33 brings the second hydraulic pump 22 into connection with one port 3*a*, and brings the other port 3*b* into connection with the tank 28. Also, the turning-dedicated directional control valve 33 closes the second center bypass passage 37. As a result, the hydraulic oil is supplied to the one port 3*a* of the turning motor 3, and the output shaft (not shown) of the turning motor 3 rotates, for example, clockwise. On the other hand, when the spool 31*a* shifts to the second offset position, the turning-dedicated directional control valve 33 brings the second hydraulic pump 22 into connection with the other port 3*b*, and brings the one port 3*a* into connection with the tank 28. Also, similar to the above, the turning-dedicated directional control valve 33 closes the second center bypass passage 37. As a result, the hydraulic oil is supplied to the other port 3*b* of the turning motor 3, and the output shaft (not shown) of the turning motor 3 rotates, for example, counterclockwise. As thus described, by switching the flow direction of the hydraulic oil from the second hydraulic pump 22, the turning-dedicated directional control valve 33 drives the turning motor 3, thereby rotating the turning unit clockwise and counterclockwise.

The three directional control valves 31 to 33 having the above-described configurations are configured as pilot-type spool valves. Each of the directional control valves 31 to 33 shifts as a result of its spool 31*a*, 32*a*, or 33*a* receiving a pressure. In the present embodiment, each of the spools 31*a* and 33*a* can receive a pilot pressure at its both ends. Each of the spools 31*a* and 33*a* shifts to the first offset position upon receiving the pilot pressure at one end thereof, and shifts to the second offset position upon receiving the pilot pressure at the other end thereof. Each of the spools 31*a* and 33*a* shifts by a stroke amount corresponding to the received pilot pressure. By an opening area corresponding to the stroke amount by which to shift, the spool 31*a* opens between the first hydraulic pump 21 and the pair of cylinders 2, and the spool 33*a* opens between the second hydraulic pump 22 and the turning motor 3. That is, the opening area between the first hydraulic pump 21 and the pair of cylinders 2 (i.e., the opening area of the spool 31*a*) is an opening area corresponding to the pilot pressure applied to the spool 31*a*, and the opening area between the second hydraulic pump 22 and the turning motor 3 (i.e., the opening area of the spool 33*a*) is an opening area corresponding to the pilot pressure applied to the spool 33*a*.

On the other hand, the spool 32*a* receives a pilot pressure only at one end thereof, and shifts to the offset position upon receiving the pilot pressure. The spool 32*a* shifts by a stroke amount corresponding to the pilot pressure applied to the one end of the spool 32*a*. By an opening area corresponding to the stroke amount, the spool 32*a* opens between the second hydraulic pump 22 and the pair of cylinders 2. That is, the opening area between the second hydraulic pump 22 and the pair of cylinders 2 (i.e., the opening area of the spool 32*a*) is an opening area corresponding to the pilot pressure applied to the spool 32*a*. In order to apply such a pilot pressure to each of the spools 31*a* to 33*a*, the hydraulic pressure supply device 25 includes two operation valves 41 and 42.

Both the two operation valves 41 and 42 include operating portions, for example, operating levers 41*a* and 42*a*, respectively. Each of the operating levers 41*a* and 42*a* is configured to be inclinable through an inclination operation thereof. To be more specific, each of the operating levers 41*a* and 42*a* is inclinable from its neutral position in two directions, i.e., one predetermined direction and the other predetermined direction. The operation valves 41 and 42 are connected to an unshown pilot pump. When the operating lever 41*a* or 42*a* is inclined, the operation valve 41 or 42 outputs a pilot pressure in a direction corresponding to the inclination direction (i.e., operating direction) of the operating lever 41*a* or 42*a*, and adjusts the pilot pressure to a pressure corresponding to the inclination amount (i.e., operating amount) of the operating lever 41*a* or 42*a*. One of the two operation valves 41 and 42 thus configured is a boom-dedicated operation valve 41 for operating the boom, and the other operation valve is a turning-dedicated operation valve 42 for operating the turning unit. That is, the operating lever 41*a* is a boom-dedicated operating portion, and the operating lever 42*a* is a turning-dedicated operating portion. Hereinafter, the operation valves 41 and 42 will be described in further detail.

The boom-dedicated operation valve 41 is connected to a first boom-dedicated pilot passage 43R and a second boom-dedicated pilot passage 43L, and outputs a pilot pressure (i.e., boom driving command) to one of the first boom-dedicated pilot passage 43R and the second boom-dedicated pilot passage 43L in accordance with the inclination direction. Although not illustrated, the first boom-dedicated pilot passage 43R branches into portions that are connected to the first boom-dedicated directional control valve 31 and the second boom-dedicated directional control valve 32, respectively. The pilot pressure outputted to the first boom-dedicated pilot passage 43R is applied to one end of the spool 31*a* of the first boom-dedicated directional control valve 31 and one end of the spool 32*a* of the second boom-dedicated directional control valve 32. The spool 31*a* shifts to the first offset position in response to the pilot pressure, and the spool 32*a* shifts to the offset position in response to the pilot pressure. Here, each of the spools 31*a* and 32*a* shifts by a stroke amount corresponding to the pilot pressure, and in accordance therewith, the opening area of each of the spools 31*a* and 32*a* is adjusted to an opening area corresponding to the pilot pressure.

On the other hand, the second boom-dedicated pilot passage 43L is connected only to the first boom-dedicated directional control valve 31. The pilot pressure outputted to the second boom-dedicated pilot passage 43L is applied to the other end of the spool 31*a* of the first boom-dedicated directional control valve 31, and the spool 31*a* shifts to the second offset position in response to the pilot pressure. Here, the spool 31*a* shifts by a stroke amount corresponding to the pilot pressure, and in accordance therewith, the opening area between the first hydraulic pump 21 and the pair of boom-dedicated cylinders 2 (i.e., the opening area of the spool 31*a*) is adjusted to an opening area corresponding to the pilot pressure.

Thus, when the operating lever 41*a* of the boom-dedicated operation valve 41 is inclined, the spool 31*a* and the spool 32*a* of the first boom-dedicated directional control valve 31 and the second boom-dedicated directional control valve 32 shift in accordance with the inclination direction and the inclination amount. As a result, the hydraulic oil in a direction corresponding to the inclination direction and at a flow rate corresponding to the inclination amount flows from the two hydraulic pumps 21 and 22 to the pair of boom-dedicated cylinders 2, and the pair of boom-dedicated cylinders 2 extends or retracts in a direction corresponding to the inclination direction and at a speed corresponding to the inclination amount. That is, the boom swings upward or downward corresponding to the inclination direction and at a speed corresponding to the inclination amount.

The turning-dedicated operation valve 42 is connected to a first turning-dedicated pilot passage 44R and a second turning-dedicated pilot passage 44L, and outputs a pilot pressure (i.e., turning driving command) to one of the first turning-dedicated pilot passage 44R and the second turning-dedicated pilot passage 44L in accordance with the inclination direction. The first turning-dedicated pilot passage 44R and the second turning-dedicated pilot passage 44L are both connected to the turning-dedicated directional control valve 33. The pilot pressure outputted to the first turning-dedicated pilot passage 44R is applied to one end of the spool 33*a* of the turning-dedicated directional control valve 33, and the pilot pressure outputted to the second turning-dedicated pilot passage 44L is applied to the other end of the spool 33*a*. When the pilot pressure outputted to the first turning-dedicated pilot passage 44R acts on the spool 33*a*, the spool 33*a* shifts to the first offset position. Here, the spool 33*a* shifts by a stroke amount corresponding to the pilot pressure, and in accordance therewith, the opening area of the spool 33*a* is adjusted to an opening area corresponding to the pilot pressure. When the pilot pressure outputted to the second turning-dedicated pilot passage 44L acts on the spool 33*a*, the spool 33*a* shifts to the second offset position. Here, the spool 33*a* shifts by a stroke amount corresponding to the pilot pressure, and the opening area of the spool 33*a* is adjusted to an opening area corresponding to the pilot pressure.

Thus, when the operating lever 42*a* of the turning-dedicated operation valve 42 is inclined, the spool 33*a* of the turning-dedicated directional control valve 33 shifts in accordance with the inclination direction and the inclination amount. As a result, the hydraulic oil in a direction corresponding to the inclination direction and at a flow rate corresponding to the inclination amount flows from the second hydraulic pump 22 to the turning motor 3, and the output shaft of the turning motor 3 rotates in a direction corresponding to the inclination direction and at a speed corresponding to the inclination amount. That is, the turning unit can be turned clockwise or counterclockwise corresponding to the inclination direction and at a speed corresponding to the inclination amount. Solenoid proportional valves 45R and 45L are interposed in the two pilot passages 44R and 44L, respectively.

The solenoid proportional valves 45R and 45L are normally open proportional valves, and each of the solenoid proportional valves 45R and 45L adjusts a pilot pressure applied to the spool 33*a*. Specifically, the solenoid proportional valves 45R and 45L are capable of receiving respective turning control commands inputted thereto. Each of the solenoid proportional valves 45R and 45L adjusts, based on the turning control command inputted thereto, a pilot pressure applied to one or the other end of the spool 33*a*. In order to feed the turning control commands to the respective solenoid proportional valves 45R and 45L having such functions, a controller 51 is electrically connected to the solenoid proportional valves 45R and 45L. It should be noted that, alternatively, the solenoid proportional valves 45R and 45L may be normally closed proportional valves.

The controller 51 and the solenoid proportional valves 45R and 45L constitute a driving control unit 11. The controller 51 outputs the turning control command to one of the solenoid proportional valves 45R and 45L in accordance with various conditions, thereby adjusting the magnitude of the pilot pressure applied to the spool 33*a*. The controller 51 is electrically connected also to four pressure sensors 52R, 52L, 53R, and 53L. The two pressure sensors 52R and 52L and the boom-dedicated operation valve 41 constitute a boom-dedicated operation unit 12. One of the two pressure sensors 52R and 52L, specifically the first boom-dedicated pressure sensor 52R, outputs a signal corresponding to the pilot pressure in the first boom-dedicated pilot passage 43R (i.e., outputs a boom operation command). The other second boom-dedicated pressure sensor 52L outputs a signal corresponding to the pilot pressure in the second boom-dedicated pilot passage 43L (i.e., outputs a boom operation command). Similarly, the remaining two pressure sensors 53R and 53L and the turning-dedicated operation valve 42 constitute a turning-dedicated operation unit 13. One of the two pressure sensors 53R and 53L, specifically the first turning-dedicated pressure sensor 53R, outputs a signal corresponding to the pilot pressure in the first turning-dedicated pilot passage 44R (i.e., outputs a turning operation command). The other second turning-dedicated pressure sensor 53L outputs a signal corresponding to the pilot pressure in the second turning-dedicated pilot passage 44L (i.e., outputs a turning operation command). The controller 51 controls the movements of the solenoid proportional valves 45R and 45L based on the operation commands outputted from the four pressure sensors 52R, 52L, 53R, and 53L.

The controller 51 is further electrically connected to the two tilting angle adjusting mechanisms 23 and 24. Specifically, the controller 51 is electrically connected to each of the solenoid proportional valves of the two tilting angle adjusting mechanisms 23 and 24, and outputs tilting angle commands to the respective solenoid proportional valves, thereby adjusting the delivery flow rates of the two hydraulic pumps 21 and 22. To be more specific, based on the operation commands outputted from the four pressure sensors 52R, 52L, 53R, and 53L, the controller 51 detects the inclination amounts of the operating levers 41*a* and 42*a*, and outputs tilting angle commands corresponding to the detected inclination amounts to the respective solenoid proportional valves, thereby adjusting the delivery flow rates of the two hydraulic pumps 21 and 22.

In the hydraulic drive system 1 thus configured, when the operating lever 41*a* of the boom-dedicated operation valve 41 is inclined in one direction, the spool 31*a* shifts to the first offset position, and also, the spool 32*a* shifts to the offset position. As a result, the hydraulic oil flows to the pair of boom-dedicated cylinders 2 in a manner to retract them, and thereby the boom swings upward. At the time, the opening area of each of the spools 31*a* and 32*a* is an opening area corresponding to the inclination amount of the operating lever 41*a*. Therefore, the boom swings upward at a speed corresponding to the operating amount of the operating lever 41*a*.

On the other hand, when the operating lever 41*a* of the boom-dedicated operation valve 41 is inclined in the other direction, the spool 31*a* shifts to the second offset position. As a result, the hydraulic oil flows to the pair of boom-dedicated cylinders 2 in a manner to extend them, and thereby the boom swings downward. At the time, the opening area of the spool 31*a* is an opening area corresponding to the inclination amount of the operating lever 41*a*, and the boom is caused to swing downward at a speed corresponding to the operating amount of the operating lever 41*a*. When the operating lever 42*a* of the turning-dedicated operation valve 42 is inclined, the hydraulic oil flows to the turning motor 3 in a direction corresponding to the inclination direction, and rotates the output shaft of the turning motor 3 in a direction corresponding to the inclination direction. The opening area of the spool 33*a* changes in accordance with the inclination amount of the operating lever 42*a* of the turning-dedicated operation valve 42, and the output shaft of the turning motor 3, i.e., the turning unit, rotates at a speed corresponding to the operating amount of the operating lever 42*a*.

Thus, in the hydraulic drive system 1, there is a case where each of the operating levers 41*a* and 42*a* is operated alone in the above-described manner (i.e., single operation) and a case where the two operating levers 41*a* and 42*a* are operated concurrently in the above-described manner (i.e., concurrent operation). In the case of a concurrent operation, similar to the case of a single operation, the spools 31*a* to 33*a* shift in accordance with the inclination directions of the operating levers 41*a* and 42*a*, and the spools 31*a* to 33*a* open at opening areas corresponding to the inclination amounts of the operating levers 41*a* and 42*a*. Meanwhile, in a boom raising operation, not only the boom, but also the arm and bucket provided on the boom need to be raised. For this reason, it is necessary to flow a large amount of hydraulic oil to the boom-dedicated cylinders 2. Therefore, in the case of a concurrent operation involving a boom raising operation, if the opening area of the spool 33*a* is set to the same opening area as in the case of a single operation, the hydraulic oil in a large amount flows to the turning motor 3, and as a result, the speed of the boom becomes slow. In this respect, in the hydraulic drive system 1, when a boom raising operation is performed as part of a concurrent operation, the controller 51 adjusts the opening area of the spool 33*a*, such that the hydraulic oil flows to the boom-dedicated cylinders 2 in a prioritized manner. Here, in order to set the degree of priority of flowing the hydraulic oil to the boom-dedicated cylinders 2, a priority degree adjuster 54 is electrically connected to the controller 51. The priority degree adjuster 54 is, for example, a dial. By operating the dial, the degree of priority of flowing the hydraulic oil to the boom-dedicated cylinders 2 is set. Hereinafter, a description is given of control steps that the controller 51 of the hydraulic drive system 1 thus configured performs in the case of flowing the hydraulic oil to the boom-dedicated cylinders 2 in a prioritized manner.

When the hydraulic excavator is powered on, the controller 51 starts driving control. When the driving control is started, the controller 51 proceeds to step S1. In step S1, which is a boom raising determination step, the controller 51 determines whether or not an operation of inclining the operating lever 41*a* of the boom-dedicated operation valve 41 in one direction, i.e., a boom raising operation, has been performed. That is, based on the boom operation command outputted from the first boom-dedicated pressure sensor 52R, the controller 51 determines whether or not the boom raising operation has been performed with the operating lever 41*a*. Specifically, based on the boom operation command outputted from the first boom-dedicated pressure sensor 52R, the controller 51 detects the pressure of the first boom-dedicated pilot passage 43R, and determines whether or not the detected pressure is higher than or equal to a first predetermined value. If the detected pressure is lower than the predetermined value, the controller 51 determines that the boom raising operation has not been performed, and returns to step S1, in which the controller 51 performs the above-described determination again. On the other hand, if the detected pressure is higher than or equal to the first predetermined value, the controller 51 determines that the boom raising operation has been performed, and proceeds to step S2.

In step S2, which is a concurrent operation determination step, in order to determine whether or not a concurrent operation has been performed, the controller 51 determines whether or not the operating lever 42*a* of the turning-dedicated operation valve 42 has been operated. That is, based on the turning operation commands outputted from the first turning-dedicated pressure sensor 53R and the second turning-dedicated pressure sensor 53L, the controller 51 determines whether or not the operating lever 42*a* has been operated. Specifically, based on the turning operation commands outputted from the first turning-dedicated pressure sensor 53R and the second turning-dedicated pressure sensor 53L, the controller 51 detects the pressure of the passage 44R and the pressure of the passage 44L, and determines whether or not at least one of the detected pressures is higher than or equal to a second predetermined value. If both the detected pressures are lower than the second predetermined value, the controller 51 determines that a single operation has been performed with the operating lever 41*a*, and returns to step S1, in which the controller 51 performs the above-described determination again. On the other hand, if at least one of the detected pressures is higher than or equal to the second predetermined value, the controller 51 determines that the operating lever 42*a* has also been operated and that a concurrent operation has been performed, and proceeds to step S3.

In step S3, which is an inclination amount determination step, the controller 51 determines whether or not the inclination amounts of the two operating levers 41*a* and 42*a* are greater than or equal to predetermined amounts (in other words, determines whether or not both of the following are satisfied: the percentage of the operating amount of the operating lever 42*a* of the turning-dedicated operation valve 42 to its maximum operating amount is higher than or equal to a first predetermined percentage; and the percentage of the operating amount of the operating lever 41*a* of the boom-dedicated operation valve 41 to its maximum operating amount is higher than or equal to a second predetermined percentage). That is, based on the signals outputted from the three pressure sensors 52R, 53R, and 53L, the controller 51 determines whether or not the inclination amounts of the two operating levers 41*a* and 42*a* are greater than or equal to the predetermined amounts. Specifically speaking, based on the operation commands outputted from the three pressure sensors 52R, 53R, and 53L, the controller 51 detects the magnitudes of the pilot pressures of the passages 43R, 44R, and 44L, and determines whether or not each detected pilot pressure magnitude is higher than or equal to a predetermined value. For each of the operation valves 41 and 42, the magnitude of the pilot pressure outputted therefrom and the inclination amount thereof correspond to each other substantially one to one. Therefore, by determining whether or not each detected pilot pressure magnitude is higher than or equal to the predetermined value, the controller 51 can determine whether or not the inclination amounts of the two operating levers 41*a* and 42*a* are greater than or equal to the predetermined amounts. It should be noted that the predetermined value is greater than the aforementioned first predetermined value and second predetermined value. For example, the predetermined value is set to 70% or more of the magnitude of the maximum pilot pressure that is outputted when each of the operating levers 41*a* and 42*a* is inclined to the maximum angle. The predetermined amounts for the respective operating levers 41*a* and 42*a* are set to the same value. Alternatively, the predetermined amounts for the respective operating levers 41*a* and 42*a* may be set to different values from each other.

If the inclination amounts of the two operating levers 41*a* and 42*a* are less than the predetermined amounts, the controller 51 determines that it is not necessary to flow the hydraulic oil to the pair of boom-dedicated cylinders 2 in a prioritized manner, and returns to step S1, in which the controller 51 performs the above-described determination again. Therefore, each of the spool 31*a* of the first boom-dedicated directional control valve 31 and the spool 32*a* of the second boom-dedicated directional control valve 32 shifts in a direction corresponding to the inclination direction of the operating lever 41*a* and by a stroke amount corresponding to the inclination amount of the operating lever 41*a*, and also, the spool 33*a* of the turning-dedicated directional control valve 33 shifts in a direction corresponding to the inclination direction of the operating lever 42*a* and by a stroke amount corresponding to the inclination amount of the operating lever 42*a*. It should be noted that, at the time, the flow rate of the hydraulic oil flowing to the boom-dedicated cylinders 2 relative to the inclination amount of the operating lever 41*a* is less than at the time of a single operation, and the raising speed of the boom is lower than at the time of a single operation. On the other hand, if the inclination amounts of the two operating levers 41*a* and 42*a* are greater than or equal to the predetermined amounts, the controller 51 proceeds to step S4.

In step S4, which is a priority control step, in order to start priority control by which to restrict the stroke amount of the spool 33*a* of the turning-dedicated directional control valve 33, the controller 51 outputs a turning control command to one of the solenoid proportional valves 45R and 45L in accordance with the inclination direction of the operating lever 42*a*. Specifically, when the operating lever 42*a* is inclined in one inclination direction, the controller 51 outputs a turning control command to the first solenoid proportional valve 45R to decrease the opening area of the first solenoid proportional valve 45R, thereby decreasing the pilot pressure outputted from the first solenoid proportional valve 45R to the spool 33*a*. On the other hand, when the operating lever 42*a* is inclined in the other inclination direction, the controller 51 outputs a turning control command to the second solenoid proportional valve 45L to decrease the opening area of the second solenoid proportional valve 45L, thereby decreasing the pilot pressure flowing through the second turning-dedicated pilot passage 44L. In this manner, the stroke amount of the spool 33*a* of the turning-dedicated directional control valve 33 is restricted compared to when a single operation is performed. By thus restricting the stroke amount of the spool 33*a* of the turning-dedicated directional control valve 33, the flow rate of the hydraulic oil supplied to the turning motor 3 can be restricted, and the hydraulic oil at a flow rate, the flow rate corresponding to a decrease in the flow rate caused by the restriction, can be supplied to the pair of boom-dedicated cylinders 2. In this manner, when a concurrent operation is performed, a decrease in the boom speed relative to the inclination amount of the operating lever 41*a*, the decrease being due to insufficiency in the amount of hydraulic oil supplied to the pair of boom-dedicated cylinders 2, can be suppressed.

It should be noted that, in the present embodiment, the opening area of the spool 33*a* has a correspondence relationship with the stroke amount of the spool 33*a*, and the opening area of the spool 33*a* is controlled by the stroke amount thereof. Accordingly, the opening area of the spool 33*a* can be restricted by restricting the stroke amount thereof. Therefore, in order to restrict the opening area of the spool 33*a* to be less than or equal to its upper limit value, the controller 51 stores therein an upper limit stroke amount of the spool 33*a*. The upper limit stroke amount is set corresponding to a degree of priority inputted by the priority degree adjuster 54, and the upper limit stroke amount has different setting values corresponding to different degrees of priority. In other words, the priority degree adjuster 54 can change the upper limit value of the opening area of the spool 33*a*. For example, there are cases, in each of which a height to which the boom is to be raised is the same, but an angle by which the turning unit is to be turned may be different between these cases. In one case, the turning unit is to be turned by a greater angle (e.g., by 180 degrees), and in another case, the turning unit is to be turned by a smaller angle (e.g., by 90 degrees). In the former case, achieving the turning speed that is close to the turning speed at a single operation is desired rather than sacrificing the turning speed to bring the raising speed of the boom close to the raising speed at a single operation. For this reason, the degree of priority in the former case is set to be less than the degree of priority in the latter case, and thereby the upper limit stroke amount in the former case is made greater than the upper limit stroke amount in the latter case. Thus, by means of the priority degree adjuster 54, a degree of freedom can be achieved in the driving control of the turning unit and the boom when a concurrent operation is performed. The controller 51 outputs the turning control command thus set, thereby preventing the spool 33*a* from shifting by a stroke amount that is greater than or equal to the upper limit stroke amount and causing the hydraulic oil to flow to the pair of boom-dedicated cylinders 2 in a prioritized manner. Then, the controller 51 proceeds to step S5.

In step S5, which is a priority control ending determination step, the controller 51 determines whether or not to continue the priority control. That is, based on whether or not the inclination amounts of the two operating levers 41*a* and 42*a* are greater than or equal to the predetermined amounts, the controller 51 determines whether or not to continue the priority control. Specifically, similar to step S3, based on the signals outputted from the three pressure sensors 52R, 53R, and 53L, the controller 51 determines whether or not the inclination amounts of the two operating levers 41*a* and 42*a* are greater than or equal to the predetermined amounts. It should be noted that, in the present embodiment, the predetermined amounts serving as determination criteria in step S5 are set to be the same as the predetermined amounts in step S3. However, as an alternative, the predetermined amounts in step S5 may be set to be different from the predetermined amounts in step S3. If the inclination amounts of the two operating levers 41*a* and 42*a* are greater than or equal to the predetermined amounts, the controller 51 returns to step S4 to continue the priority control. On the other hand, if the inclination amounts of the two operating levers 41*a* and 42*a* are less than the predetermined amounts, the controller 51 ends the priority control, and returns to step S1, in which the controller 51 determines the presence or absence of a boom raising operation again.

It should be noted that, in conjunction with the above-described priority control, the controller 51 performs rapid change prevention control as described below. Specifically, also at the time of performing a concurrent operation, when the operating lever 42*a* is operated, the controller 51 increases/decreases the turning control command in accordance with the operating amount of the operating lever 42*a*. However, the controller 51 restricts the increase/decrease rate of the turning control command to be less than or equal to a predetermined increase/decrease rate. That is, the controller 51 restricts the increase/decrease rate of the pilot pressure flowing through one of the first turning-dedicated pilot passage 44R and the second turning-dedicated pilot passage 44L to be less than or equal to a predetermined increase/decrease rate. Accordingly, when the solenoid proportional valve 45R or 45L, to which the turning control command is inputted, is opened or closed, the opening area can be increased or decreased with a predetermined temporal gradient. That is, a change in the opening area of the spool 33*a* can be caused to have a temporal gradient, and thereby a rapid change in the opening area of the spool 33*a* can be suppressed. For example, when starting the priority control, the controller 51 can prevent the opening area of the spool 33*a* from rapidly decreasing, and when ending the priority control, the controller 51 can suppress the opening area of the spool 33*a* from rapidly increasing. This makes it possible to prevent the amount of hydraulic oil flowing into the turning motor 3 from rapidly increasing or decreasing, and thereby the occurrence of a shock on the turning unit can be suppressed. Also during the priority control being performed, the increase/decrease rate of the turning control command relative to the operating amount of the operating lever 42*a* is restricted to be less than or equal to the predetermined increase/decrease rate. Thus, in the priority control (i.e., when a concurrent operation is performed), the controller 51 can suppress the occurrence of a shock on the turning unit even if the operating lever 42*a* is operated rapidly.

In the hydraulic drive system 1 thus configured, when a concurrent operation is performed, the pilot pressure applied to the spool 33*a* of the turning-dedicated directional control valve 33 is adjusted so as to make the opening area of the spool 33*a* less than when a single operation is performed. In this manner, the stroke amount of the spool 33*a* is restricted. This makes it possible to flow the hydraulic oil to the pair of boom-dedicated cylinders 2 in a prioritized manner. On the other hand, when a single operation is performed, the opening area of the spool 33*a* can be made greater than when a concurrent operation is performed. Therefore, when a single operation is performed, the occurrence of pressure loss between the second hydraulic pump 22 and the turning-dedicated directional control valve 33 can be suppressed, which makes it possible to reduce energy consumption of the entire hydraulic drive system 1.

Further, in the hydraulic drive system 1, when the percentages of the operating amounts of the operating levers 41*a* and 42*a* to the maximum operating amounts are less than the first and second predetermined percentages, the priority control can be prevented from being performed. That is, in the above-described case, when the operating levers 41*a* and 42*a* are operated, the operations performed on the operating levers 41*a* and 42*a* and movements of the pair of boom-dedicated cylinders 2 and the turning motor 3 can be made correspond to each other, and even when a concurrent operation is performed, the pair of boom-dedicated cylinders 2 and the turning motor 3 can be moved while finely adjusting their movements.

It should be noted that, in the present embodiment, among configurations included in the hydraulic pressure supply device 25, only the configuration that drives the boom and the turning unit and that is mainly related to the priority control is described with illustration. However, the hydraulic pressure supply device 25 further includes other various configurations. That is, the hydraulic drive system 1 is capable of driving not only the boom and the turning unit, but also the arm, the bucket, and the running unit. Specifically, the hydraulic drive system 1 includes, for example, a configuration that drives an arm-dedicated cylinder (i.e., first and second arm-dedicated directional control valves and an arm-dedicated operation valve), a configuration that drives a bucket-dedicated cylinder (i.e., a bucket-dedicated directional control valve and a bucket-dedicated operation valve), and a configuration that drives a pair of right and left running unit-dedicated hydraulic motors (i.e., first and second running-dedicated directional control valves and first and second running-dedicated operation valves).

To be more specific, the first running-dedicated directional control valve, the bucket-dedicated directional control valve, and the first arm-dedicated directional control valve are connected so as to be parallel to the first boom-dedicated directional control valve 31 on the first main passage 34, and also, together with the first boom-dedicated directional control valve 31, connected in series to the first center bypass passage 36. Each of these directional control valves is configured in the same manner as the first boom-dedicated directional control valve 31. These directional control valves shift their spools in accordance with the inclination directions and the inclination amounts of the corresponding operation valves to control the flow directions and the flow rates of the hydraulic oil flowing to the arm-dedicated cylinder, the bucket-dedicated cylinder, and one of the running unit-dedicated hydraulic motors, thereby moving the running unit, the bucket, and the arm.

The second running-dedicated directional control valve and the second arm-dedicated directional control valve are connected so as to be parallel to the second boom-dedicated directional control valve 32 and the turning-dedicated directional control valve 33 on the second main passage 35, and also, together with the second boom-dedicated directional control valve 32 and the turning-dedicated directional control valve 33, connected in series to the second center bypass passage 37. Each of these directional control valves is configured in the same manner as the first boom-dedicated directional control valve 31. These directional control valves shift their spools in accordance with the inclination directions and the inclination amounts of the corresponding operation valves to control the flow directions and the flow rates of the hydraulic oil flowing to the arm-dedicated cylinder and the other one of the running unit-dedicated hydraulic motors, thereby moving the running unit and the arm.

As described above, the hydraulic pressure supply device 25 is capable of supplying the hydraulic liquid to the arm-dedicated cylinder, the bucket-dedicated cylinder, and the running unit-dedicated hydraulic motors in accordance with operations performed on the corresponding operation valves, thereby moving the arm, the bucket, and the running unit in a manner similar to the boom and the turning unit. There may be a case where the hydraulic pressure supply device 25 is configured to be able to supply the hydraulic oil to other actuators than those mentioned above. In such a case, the hydraulic pressure supply device 25 includes directional control valves and operation valves corresponding to these other actuators

Embodiment 2

A hydraulic drive system 1A of Embodiment 2 is similar in configuration to the hydraulic drive system 1 of Embodiment 1. Therefore, the description below regarding the configuration of the hydraulic drive system 1A of Embodiment 2 mainly describes differences from the configuration of the hydraulic drive system 1 of Embodiment 1. In Embodiment 2, the same components as those described in Embodiment 1 are denoted by the same reference signs as those used in Embodiment 1, and descriptions of such components are omitted.

Figure 3:
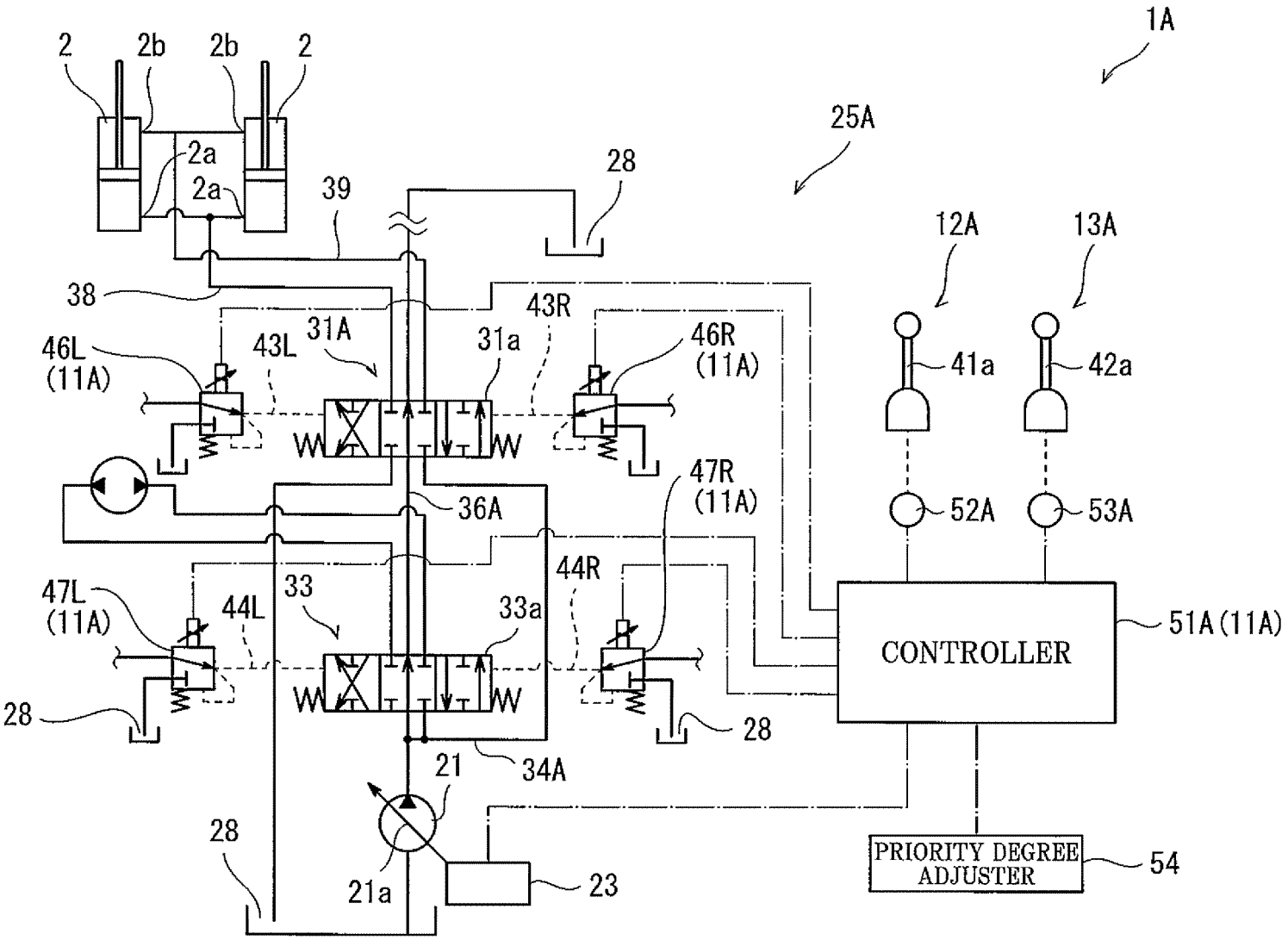
FIG. 3 is a circuit diagram showing a hydraulic circuit of a hydraulic drive system according to Embodiment 2 of the present invention.

As shown in FIG. 3, the hydraulic drive system 1A of Embodiment 2 includes the hydraulic pump 21, the tilting angle adjusting mechanism 23, and a hydraulic pressure supply device 25A. The hydraulic pump 21 is connected to the actuators 2 and 3 via the hydraulic pressure supply device 25A. In order to change the direction and the flow rate of the hydraulic oil flowing to the hydraulic pressure supply device 25A, the hydraulic pressure supply device 25A includes a boom-dedicated directional control valve 31A and the turning-dedicated directional control valve 33. The boom-dedicated directional control valve 31A and the turning-dedicated directional control valve 33 are connected to the hydraulic pump 21 via a first main passage 34A, such that the boom-dedicated directional control valve 31A and the turning-dedicated directional control valve 33 are parallel to each other. In a first center bypass passage 36A branched off from the first main passage 34A, the turning-dedicated directional control valve 33 and the boom-dedicated directional control valve 31A are interposed in series in this order. Both ends of spools 31*a* and 33*a* of the directional control valves 31A and 33 are connected to a pilot pump via the pilot passages 43R, 43L, 44R, and 44L. The pilot pump delivers pilot oil in a constant amount at a constant pressure. The pilot oil delivered from the pilot pump can be led to each of both ends of the spools 31*a* and 33*a* via a corresponding one of the pilot passages 43R, 43L, 44R, and 44L. In order to adjust the pressure of the pilot oil led to each of both ends of the spools 31*a* and 33*a* and output a pilot pressure to each of the spools 31*a* and 33*a*, solenoid proportional valves 46R, 46L, 47R, and 47L are interposed in the pilot passages 43R, 43L, 44R, and 44L, respectively.

The solenoid proportional valves 46R, 46L, 47R, and 47L output pilot pressures to the spools 31*a* and 33*a*. To be more specific, the first and second boom-dedicated solenoid proportional valves 46R and 46L are capable of receiving respective boom control commands inputted thereto. Each of the first and second boom-dedicated solenoid proportional valves 46R and 46L adjusts, based on the boom control command inputted thereto, the pressure of the pilot oil flowing through a corresponding one of the two pilot passages 43R and 43L, and outputs a pilot pressure corresponding to the boom control command (i.e., outputs a boom driving command) to the spool 31*a*. On the other hand, the first and second turning-dedicated solenoid proportional valves 47R and 47L are capable of receiving respective turning control commands inputted thereto. Each of the first and second turning-dedicated solenoid proportional valves 47R and 47L adjusts, based on the turning control command inputted thereto, the pressure of the pilot oil flowing through a corresponding one of the two pilot passages 44R and 44L, and outputs a pilot pressure corresponding to the turning control command (i.e., outputs a turning driving command) to the spool 33*a*. A controller 51A is electrically connected to the four solenoid proportional valves 46R, 46L, 47R, and 47L thus configured.

The controller 51A and the four solenoid proportional valves 46R, 46L, 47R, and 47L constitute a driving control unit 11A. The controller 51A outputs control commands to the solenoid proportional valves 46R, 46L, 47R, and 47L, respectively. A boom-dedicated operation unit 12A and a turning-dedicated operation unit 13A are electrically connected to the controller 51A. The boom-dedicated operation unit 12A is a so-called electrical joystick, and includes the operating lever 41*a* and an angle sensor 52A. The angle sensor 52A of the boom-dedicated operation unit 12A outputs a signal corresponding to the inclination direction and the inclination amount (i.e., inclination angle) of the operating lever 41*a* (i.e., outputs a boom operation command) to the controller 51A. The turning-dedicated operation unit 13A is also an electrical joystick, and includes the operating lever 42*a* and an angle sensor 53A. The angle sensor 53A of the turning-dedicated operation unit 13A outputs a signal corresponding to the inclination direction and the inclination angle of the operating lever 42*a* (i.e., outputs a turning operation command) to the controller 51A.

When the boom operation command is inputted to the controller 51A, the controller 51A outputs a boom control command to one of the two boom-dedicated solenoid proportional valves 46R and 46L in accordance with the inclination direction. Specifically, when the operating lever 41*a* is inclined in one inclination direction, the controller 51A outputs a boom control command corresponding to the inclination angle to the first boom-dedicated solenoid proportional valve 46R. As a result, the first boom-dedicated solenoid proportional valve 46R opens at an opening area corresponding to the inclination angle. That is, a pilot pressure whose magnitude corresponds to the inclination angle is outputted to one end of the spool 31*a*, and the spool 31*a* shifts toward the first offset position by a stroke amount corresponding to the pilot pressure. Consequently, the hydraulic oil flows to the pair of boom-dedicated cylinders 2 in a manner to retract them, and thereby the boom swings upward. At the time, the opening area of the spool 31*a* is an opening area corresponding to the stroke amount of the spool 31*a* (i.e., corresponding to the inclination angle of the operating lever 41*a*), and the boom swings upward at a speed corresponding to the inclination angle of the operating lever 41*a*.

On the other hand, when the operating lever 41*a* is inclined in the other inclination direction, the controller 51A outputs a boom control command corresponding to the inclination angle to the second boom-dedicated solenoid proportional valve 46L. As a result, the second boom-dedicated solenoid proportional valve 46L opens at an opening area corresponding to the inclination angle. That is, a pilot pressure whose magnitude corresponds to the inclination angle is outputted to the other end of the spool 31*a*, and the spool 31*a* shifts toward the second offset position by a stroke amount corresponding to the pilot pressure. Consequently, the hydraulic oil flows to the pair of boom-dedicated cylinders 2 in a manner to extend them, and thereby the boom swings downward. At the time, the opening area of the spool 31*a* is an opening area corresponding to the stroke amount of the spool 31*a* (i.e., corresponding to the inclination angle of the operating lever 41*a*), and the boom swings downward at a speed corresponding to the inclination angle of the operating lever 41*a*. It should be noted that when the operating lever 41*a* is brought back to the neutral position, the two boom-dedicated solenoid proportional valves 46R and 46L are both closed; the pilot pressures at both ends of the spool 31*a* become the tank pressure; and the spool 31*a* returns to the neutral position.

The controller 51A performs the same control also on the two turning-dedicated solenoid proportional valves 47R and 47L. When the operating lever 42*a* is inclined, the controller 51A outputs a turning control command to one of the two turning-dedicated solenoid proportional valves 47R and 47L in accordance with the inclination direction of the operating lever 42*a*. For example, when the operating lever 42*a* is inclined in one direction, the first turning-dedicated solenoid proportional valve 47R opens at an opening area corresponding to the inclination angle. That is, a pilot pressure whose magnitude corresponds to the inclination angle is outputted to one end of the spool 33*a*, and the spool 33*a* shifts toward the first offset position by a stroke amount corresponding to the pilot pressure. Consequently, the hydraulic oil flows to the turning motor 3 in a direction corresponding to the inclination direction, and rotates the output shaft of the turning motor 3 in a direction corresponding to the inclination direction. At the time, the opening area of the spool 33*a* is an opening area corresponding to the stroke amount of the spool 33*a* (i.e., corresponding to the inclination angle of the operating lever 42*a*), and the output shaft of the turning motor 3 rotates at a speed corresponding to the operating amount of the operating lever 42*a*. It should be noted that when the operating lever 42*a* is brought back to the neutral position, the two turning-dedicated solenoid proportional valves 47R and 47L are both closed; the pilot pressures at both ends of the spool 33*a* become the tank pressure; and the spool 33*a* returns to the neutral position. As a result, the output shaft of the turning motor 3 decreases in speed and comes to a stop.

Figure 4:
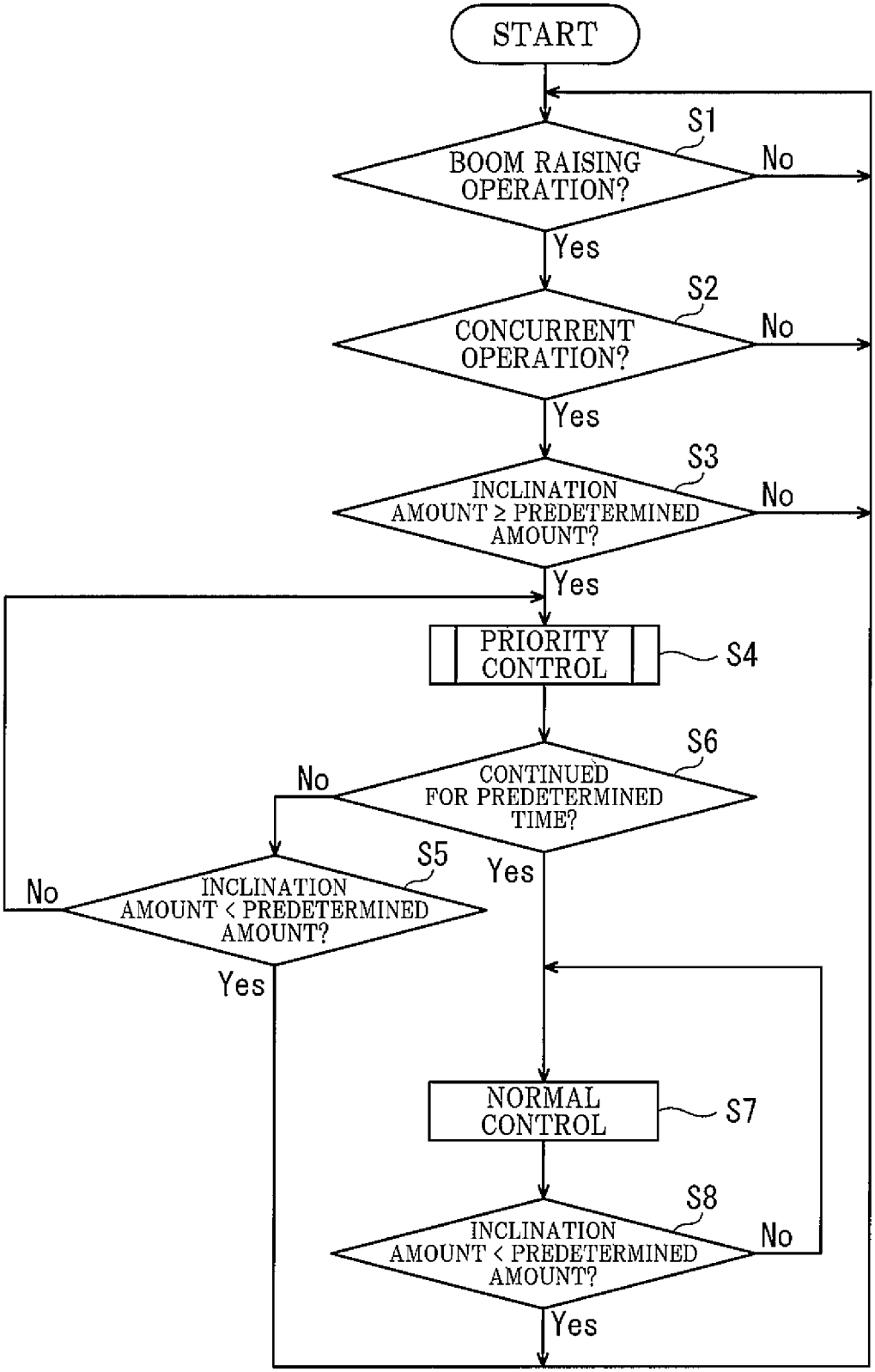
FIG. 4 is a flowchart showing the steps of driving each actuator in the hydraulic drive system of FIG. 3.

In the hydraulic drive system 1A thus configured, similar to the hydraulic drive system 1 of Embodiment 1, in the case of performing a concurrent operation including a boom raising operation, priority control is performed in order to flow the hydraulic oil to the boom-dedicated cylinders 2 in a prioritized manner. It should be noted that, similar to the hydraulic drive system 1 of Embodiment 1, the priority degree adjuster 54 is electrically connected to the controller 51A, and the degree of priority can be changed by means of the priority degree adjuster 54. Hereinafter, with reference to FIG. 4, a brief description is given of control steps that the controller 51A of the hydraulic drive system 1A performs in the case of flowing the hydraulic oil to the boom-dedicated cylinders 2 in a prioritized manner.

When the hydraulic excavator is powered on, the controller 51A starts driving control. When the driving control is started, the controller 51A proceeds to step S1. In step S1, which is a boom raising operation determination step, the controller 51A determines, based on the boom operation command outputted from the angle sensor 52A, whether or not a boom raising operation has been performed with the operating lever 41*a*. Specifically, based on the boom operation command, the controller 51A detects the inclination angle of the operating lever 41*a*, and determines whether or not the detected inclination angle is greater than or equal to a predetermined first angle. If the detected inclination angle is less than the first angle, the controller 51A determines that the boom raising operation has not been performed, and returns to step S1, in which the controller 51A performs the above-described determination again. On the other hand, if the detected inclination angle is greater than or equal to the first angle, the controller 51A determines that the boom raising operation has been performed, and proceeds to step S2.

In step S2, which is a concurrent operation determination step, in order to determine whether or not a concurrent operation has been performed, the controller 51A determines, based on the turning operation command outputted from the angle sensor 53A, whether or not the operating lever 42*a* has been operated. Specifically, based on the turning operation command outputted from the angle sensor 53A, the controller 51A detects the inclination angle of the operating lever 42*a*, and determines whether or not the detected inclination angle is greater than or equal to a predetermined second angle. If the detected inclination angle is less than the second angle, the controller 51A determines that a single operation has been performed with the operating lever 41*a*, and returns to step S1, in which the controller 51A performs the above-described determination again. On the other hand, if the detected inclination angle is greater than or equal to the second angle, the controller 51A determines that the operating lever 42*a* has also been operated and that a concurrent operation has been performed, and proceeds to step S3.

In step S3, which is an inclination angle determination step, the controller 51A determines, based on the operation commands outputted from the two angle sensors 52A and 53A, whether or not the inclination angles of the two operating levers 41*a* and 42*a* are greater than or equal to predetermined angles (in other words, determines whether or not both of the following are satisfied: the percentage of the operating amount of the operating lever 42*a* of the turning-dedicated operation unit 13A to its maximum operating amount is higher than or equal to a first predetermined percentage; and the percentage of the operating amount of the operating lever 41*a* of the boom-dedicated operation unit 12A to its maximum operating amount is higher than or equal to a second predetermined percentage). If the inclination angles of the two operating levers 41*a* and 42*a* are less than the predetermined angles, the controller 51A determines that it is not necessary to flow the hydraulic oil to the pair of boom-dedicated cylinders 2 in a prioritized manner, and returns to step S1, in which the controller 51A performs the above-described determination again. On the other hand, if the inclination angles of the two operating levers 41*a* and 42*a* are greater than or equal to the predetermined angles, the controller 51A proceeds to step S4.

In step S4, which is a priority control step, in order to start priority control by which to restrict the stroke amount of the spool 33*a* of the turning-dedicated directional control valve 33, the controller 51A adjusts the turning control command outputted in accordance with the inclination direction of the operating lever 42*a*. Specifically, when the operating lever 42*a* is inclined in one inclination direction, the controller 51A adjusts the turning control command outputted to the first turning-dedicated solenoid proportional valve 47R to decrease the opening area of the first turning-dedicated solenoid proportional valve 47R, thereby decreasing the pilot pressure outputted from the first turning-dedicated solenoid proportional valve 47R to the spool 33*a*. On the other hand, when the operating lever 42*a* is inclined in the other inclination direction, the controller 51A adjusts the turning control command outputted to the second turning-dedicated solenoid proportional valve 47L to decrease the opening area of the second turning-dedicated solenoid proportional valve 47L, thereby decreasing the pilot pressure outputted from the second turning-dedicated solenoid proportional valve 47L to the spool 33*a*. In this manner, the stroke amount of the spool 33*a* of the turning-dedicated directional control valve 33 is reduced compared to when a single operation is performed. By thus reducing the stroke amount of the spool 33*a* of the turning-dedicated directional control valve 33, the flow rate of the hydraulic oil supplied to the turning motor 3 can be restricted, and the hydraulic oil at a flow rate, the flow rate corresponding to a decrease in the flow rate caused by the restriction, can be supplied to the pair of boom-dedicated cylinders 2. In this manner, when a concurrent operation is performed, a decrease in the boom speed relative to the inclination angle of the operating lever 41*a*, the decrease being due to insufficiency in the amount of hydraulic oil supplied to the pair of boom-dedicated cylinders 2, can be suppressed. It should be noted that, similar to the controller 51 of Embodiment 1, in the priority control, the controller 51A restricts the stroke amount to be less than the upper limit stroke amount. The upper limit stroke amount is set corresponding to a degree of priority inputted by the priority degree adjuster 54, and the upper limit stroke amount has different setting values corresponding to different degrees of priority. After restricting the stroke amount of the spool 33*a* to be less than the upper limit stroke amount and flowing the hydraulic oil to the pair of boom-dedicated cylinders 2 in a prioritized manner, the controller 51A proceeds to step S6.

In step S6, which is a predetermined time continuity determination step, the controller 51A determines whether or not a state in which the inclination angles of the two operating levers 41*a* and 42*a* are greater than or equal to the predetermined angles has continued for a predetermined time or longer. When it is determined in step S3 that the inclination angles of the two operating levers 41*a* and 42*a* are greater than or equal to the predetermined angles, the controller 51A starts measuring a time, and determines whether or not the measured time is longer than or equal to the predetermined time. If the measured time is shorter than the predetermined time, the controller 51A proceeds to step S5. On the other hand, if it is determined that the measured time is longer than or equal to the predetermined time, the controller 51A proceeds to step S7.

In step S5, which is a priority control ending determination step, similar to step S3, the controller 51A determines, based on the operation commands outputted from the two angle sensors 52A and 53A, whether or not the inclination angles of the two operating levers 41*a* and 42*a* are greater than or equal to the predetermined angles. If the inclination angles of the two operating levers 41*a* and 42*a* are greater than or equal to the predetermined angles, the controller 51A returns to step S4, in which the controller 51A performs the priority control again. On the other hand, if the inclination angles of the two operating levers 41*a* and 42*a* are less than the predetermined angles, the controller 51A ends the priority control, and returns to step S1, in which the controller 51A determines the presence or absence of a boom raising operation again.

In step S7, which is a normal control step, the controller 51A outputs a turning control command that is the same as one outputted when a single operation is performed, i.e., outputs an unadjusted turning control command corresponding to the operating amount of the operating lever 42*a*, and performs normal control while cancelling the priority control. It should be noted that when cancelling the priority control, rapid change prevention control described below is performed so that the opening area of the spool 33*a* will not increase rapidly. Specifically, the opening area of the spool 33*a* corresponding to the operating amount of the operating lever 42*a* is increased, with a temporal gradient, to the same opening area as in the case of a single operation, and thus the priority control is cancelled gradually. After the priority control is cancelled in this manner, the controller 51A proceeds to step S8.

In step S8, which is a priority control ending determination step, similar to step S5, the controller 51A determines, based on the operation commands outputted from the two angle sensors 52A and 53A, whether or not the inclination angles of the two operating levers 41*a* and 42*a* are greater than or equal to the predetermined angles. If the inclination angles of the two operating levers 41*a* and 42*a* are greater than or equal to the predetermined angles, the controller 51A returns to step S7, in which the controller 51A performs the normal control (i.e., the control of outputting a turning control command corresponding to the operating amount of the operating lever 42*a*) again. On the other hand, if the inclination angles of the two operating levers 41*a* and 42*a* are less than the predetermined angles, the controller 51A returns to step S1, in which the controller 51A determines the presence or absence of a boom raising operation again.

It should be noted that, similar to the controller 51 of Embodiment 1, the controller 51A of Embodiment 2 also performs rapid change prevention control as described below in conjunction with the above-described priority control. Specifically, also at the time of performing a concurrent operation, when the operating lever 42*a* is operated, the controller 51A increases/decreases the turning control command in accordance with the operating amount of the operating lever 42*a*. However, the controller 51A restricts the increase/decrease rate of the turning control command to be less than or equal to the predetermined increase/decrease rate. In this manner, a rapid change in the opening area command due to the cancellation and ending of the priority control can be prevented, and a rapid increase/decrease in the amount of hydraulic oil flowing into the turning motor 3 can be prevented, which makes it possible to suppress the occurrence of a shock on the turning unit.

In addition, the hydraulic drive system 1A provides the same functional advantages as those provided by the hydraulic drive system 1 of Embodiment 1.

Other Embodiments

In the hydraulic drive systems 1 and 1A of Embodiments 1 and 2, pilot-type spool valves are adopted as the directional control valves 31 to 33 and 31A. However, the directional control valves 31 to 33 and 31A are not limited to such valves. For example, the directional control valves 31 to 33 and 31A may be valves capable of shifting their spools 31*a* to 33*a* by means of linear motion motors. In this case, the controllers 51 and 51A output electrical signals as driving commands to the directional control valves 31 to 33 and 31A, thereby controlling the movements of these valves. In the hydraulic drive systems 1 and 1A of Embodiments 1 and 2, the priority degree adjuster 54 is configured as a dial. Alternatively, the priority degree adjuster 54 may be configured as a plurality of buttons with which the degree of priority is adjustable. Further alternatively, the priority degree adjuster 54 may be configured as a touch panel with which the degree of priority is selectable.

The hydraulic drive systems 1 and 1A of Embodiments 1 and 2 include the first center bypass passage 36, the second center bypass passage 37 and center bypass passage 36A. However, the first center bypass passage 36, the second center bypass passage 37 and center bypass passage 36A are not essential. The main passages 34, 35 and 34A may be provided with unloading valves, respectively. In this case, the controllers 51 and 51A move the unloading valves in accordance with operations of inclining the operating levers 41*a* and 42*a*. Accordingly, when the operations of inclining the operating levers 41*a* and 42*a* are performed, the controllers 51 and 51A can lead the hydraulic oil from the hydraulic pumps 21 and 22 to the corresponding actuators 2 and 3.

The foregoing description of the hydraulic drive systems 1 and 1A of Embodiments 1 and 2 describes the priority control that is performed when the two operating levers 41*a* and 42*a* are operated concurrently, i.e., when a boom raising operation and a turning operation are performed concurrently. However, the concurrent operation is not thus limited. For example, the priority control is applicable not only to a concurrent operation in which a boom raising operation and a turning operation are performed concurrently, but also to a concurrent operation in which an arm operation and/or a bucket operation is/are additionally performed concurrently, i.e., applicable to a concurrent operation in which three or more operations are performed concurrently.

REFERENCE SIGNS LIST

1, 1A hydraulic drive system
2 boom-dedicated cylinder
3 turning motor
11, 11A driving control unit
12, 12A boom-dedicated operation unit
13, 13A turning-dedicated operation unit
21 first hydraulic pump
22 second hydraulic pump
31 first boom-dedicated directional control valve (boom-dedicated control valve)
31A boom-dedicated directional control valve (boom-dedicated control valve)
32 second boom-dedicated directional control valve (boom-dedicated control valve)
33 turning-dedicated directional control valve (turning-dedicated control valve)
41*a* operating lever (boom-dedicated operating portion)
42*a* operating lever (turning-dedicated operating portion)
45R first solenoid proportional valve
45L second solenoid proportional valve
46R first boom-dedicated solenoid proportional valve
46L second boom-dedicated solenoid proportional valve
47R first turning-dedicated solenoid proportional valve
47L second turning-dedicated solenoid proportional valve
51, 51A controller
54 priority degree adjuster

The invention claimed is:

1. A hydraulic drive system comprising:

a hydraulic pump that delivers hydraulic oil to supply the hydraulic oil to a boom-dedicated cylinder and a turning motor;

a boom-dedicated control valve interposed between the hydraulic pump and the boom-dedicated cylinder, the boom-dedicated control valve adjusting an opening area between the hydraulic pump and the boom-dedicated cylinder in accordance with a boom driving command inputted to the boom-dedicated control valve;

a turning-dedicated control valve interposed between the hydraulic pump and the turning motor and connected to the hydraulic pump such that the turning-dedicated control valve is parallel to the boom-dedicated control valve, the turning-dedicated control valve adjusting an opening area between the hydraulic pump and the turning motor in accordance with a turning driving command inputted to the turning-dedicated control valve;

a boom-dedicated operation unit including a boom-dedicated operating portion that is operated to determine the boom driving command to the boom-dedicated control valve, the boom-dedicated operation unit outputting a boom operation command corresponding to an operating amount of the boom-dedicated operating portion;

a turning-dedicated operation unit including a turning-dedicated operating portion that is operated to determine the turning driving command to the turning-dedicated control valve, the turning-dedicated operation unit outputting a turning operation command corresponding to an operating amount of the turning-dedicated operating portion; and a driving control unit that adjusts the turning driving command based on the boom operation command outputted from the boom-dedicated operation unit and the turning operation command outputted from the turning-dedicated operation unit, wherein in a case where a concurrent operation is performed the driving control unit adjusts the turning driving command such that the opening area between the hydraulic pump and the turning motor, the opening area corresponding to the operating amount of the turning-dedicated operation portion, is less than a case where a single operation is performed, and such that the opening area between the hydraulic pump and the turning motor is less than or equal to an upper limit value, the concurrent operation being an operation in which the turning operation command is outputted from the turning-dedicated operation unit and the boom operation command is outputted from the boom-dedicated operation unit, the single operation being an operation in which the turning operation command is outputted from the turning-dedicated operation unit, but the boom operation command is not outputted from the boom-dedicated operation unit, and the hydraulic drive system further comprises a priority degree adjuster that is capable of changing the upper limit value.

2. The hydraulic drive system according to claim 1, wherein in the case where the concurrent operation is performed, if a state in which the turning-dedicated operating portion is operated by a predetermined operating amount has continued for a predetermined time, the driving control unit adjusts the turning driving command to bring the opening area between the hydraulic pump and the turning motor back to the same opening area as in the case where the single operation is performed.

3. The hydraulic drive system according to claim 1, wherein in the case where the concurrent operation is performed, when the turning-dedicated operating portion is operated and the opening area between the hydraulic pump and the turning motor is adjusted, the driving control unit restricts an increase/decrease rate of the turning driving command to be less than or equal to a predetermined increase/decrease rate.

4. The hydraulic drive system according to claim 1, wherein when a percentage of the operating amount of the turning-dedicated operating portion to a maximum operating amount of the turning-dedicated operating portion is higher than or equal to a first predetermined percentage, and a percentage of the operating amount of the boom-dedicated operating portion to a maximum operating amount of the boom-dedicated operating portion is higher than or equal to a second predetermined percentage, the driving control unit adjusts the turning driving command.

5. The hydraulic drive system according to claim 1, wherein the turning-dedicated operation unit outputs, as the turning driving command, a pilot pressure whose magnitude corresponds to the operating amount of the turning-dedicated operating portion, the turning-dedicated control valve controls the opening area between the hydraulic pump and the turning motor in accordance with the pilot pressure, the driving control unit includes a solenoid proportional valve and a controller, the solenoid proportional valve adjusts the pilot pressure based on a turning control command inputted to the solenoid proportional valve, and in the case where the concurrent operation is performed, the controller outputs the turning control command to the solenoid proportional valve to adjust the pilot pressure, such that the opening area between the hydraulic pump and the turning motor is decreased.

6. The hydraulic drive system according to claim 1, wherein the driving control unit includes a solenoid proportional valve and a controller, the solenoid proportional valve outputs, as the turning driving command to the turning-dedicated control valve, a pilot pressure whose magnitude corresponds to a turning control command inputted to the solenoid proportional valve, and the controller:

in the case where the single operation is performed, outputs the turning control command to the solenoid proportional valve to cause the solenoid proportional valve to output the pilot pressure corresponding to the turning operation command outputted from the turning-dedicated operation unit; and in the case where the concurrent operation is performed, outputs the turning control command to the solenoid proportional valve to adjust the pilot pressure, such that the opening area between the hydraulic pump and the turning motor relative to the operating amount of the turning-dedicated operating portion is less than in the case where the single operation is performed.

* * * * *